US007102278B2

(12) United States Patent
Oh et al.

(10) Patent No.: US 7,102,278 B2
(45) Date of Patent: Sep. 5, 2006

(54) FIELD EMISSION DISPLAY HAVING CARBON-BASED EMITTERS

(75) Inventors: Tae-Sik Oh, Suwon (KR); Seong-Yeon Hwang, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 433 days.

(21) Appl. No.: 10/624,723

(22) Filed: Jul. 21, 2003

(65) Prior Publication Data

US 2004/0036409 A1 Feb. 26, 2004

(30) Foreign Application Priority Data

Aug. 21, 2002 (KR) ..... 10-2002-0049481

(51) Int. Cl.
*H01J 63/304* (2006.01)
*H01J 1/30* (2006.01)
*H01J 1/46* (2006.01)

(52) U.S. Cl. ..... 313/495; 313/310; 313/311; 313/496; 313/497

(58) Field of Classification Search ..... 313/495–497, 313/309–311

See application file for complete search history.

(56) References Cited

U.S. PATENT DOCUMENTS 5,191,217 A * 3/1993 Kane et al. ..... 313/309
6,420,726 B1 * 7/2002 Choi et al. ..... 313/309

* cited by examiner

*Primary Examiner*—Mariceli Santiago
(74) *Attorney, Agent, or Firm*—Christie, Parker & Hale, LLP

(57) ABSTRACT

A field emission display includes a first substrate. At least one gate electrode is formed in a predetermined pattern on the first substrate. A plurality of cathode electrodes is formed on the first substrate in a predetermined pattern. At least one first insulation layer is formed between the at least one gate electrode and the plurality of cathode electrodes. Emitters are mounted within openings of the cathode electrodes formed in the cathode electrodes. A second insulation layer having a plurality of channels is formed on the cathode electrodes such that the emitters are positioned within the channels. At least one focusing electrode is formed on the second insulation layer. A second substrate is provided opposing the first substrate with a predetermined gap therebetween. At least one anode electrode is formed on a surface of the second substrate opposing the first substrate. Phosphor layers are formed on the anode electrode in a predetermined pattern.

23 Claims, 11 Drawing Sheets

FIELD EMISSION DISPLAY HAVING CARBON-BASED EMITTERS

CROSS REFERENCE TO RELATED APPLICATIONS

This application claims priority to and the benefit of Korea Patent Application No. 2002-0049481 filed on Aug. 21, 2002 in the Korean Intellectual Property Office, the entire disclosure of which is incorporated herein by reference.

BACKGROUND OF THE INVENTION (a) Field of the Invention

The present invention relates to field emission displays (FEDs), and more particularly, to FEDs having carbon-based emitters.

(b) Description of the Related Art

The FED uses a cold cathode as the source for emitting electrons, which are used to realize the display of images. The overall quality of the FED depends on material and structural characteristics of emitters, which form an electron emitting layer. The first FEDs utilized emitters made mainly of molybdenum (Mo). Subsequently, Spindt-type metal tip (or microtip) emitters were developed.

However, in manufacturing the FED having metal tip emitters, it is necessary to form extremely minute openings into which the emitters are provided, and it is also necessary to deposit Mo and uniformly form the metal microtips over an entire region of a screen. As a result, production is complicated, and not only is a high technology process needed, expensive equipment is required for manufacture such that unit costs tend to increase. It is also difficult to manufacture FEDs of a large screen size.

Accordingly, much research and development is being performed by those in the FED industry to form emitters in a flat configuration that enable good electron emission at low voltage driving conditions and are relatively simple to manufacture. It is known that carbon-based materials, for example, graphite, diamond, diamond-like carbon (DLC), $C_{60}$ (Fullerene), or carbon nanotubes (CNTs), are suitable for use in manufacture of flat emitters. In particular, it is believed that CNTs, with their ability to realize favorable electron emission at relatively low driving voltages is the ideal material for emitters in FEDs.

The FEDs using CNT technology typically employ a triode structure having cathodes, an anode, and gate electrodes. With these FEDs, cathode electrodes are first formed on a substrate. Then an insulating layer and gate electrodes including minute openings are deposited over the cathode electrodes. Emitters are then formed in the openings such that the emitters are positioned on the cathode electrodes.

However, with the FED having the above triode structure, a reduction in color purity occurs and it is difficult to realize sharp pictures. When the electrons emitted from the emitters form electron beams and travel toward phosphors, a diverging force of the electron beams is increased by a voltage (a positive voltage of a few to a few tens of volts) applied to the gate electrodes such that the electron beams scatter. The electron beams therefore land on unintended phosphors to illuminate the same. Reduction in color purity results and sharp pictures become difficult to realize.

In order to prevent these problems, there are efforts to minimize the size of an emitter corresponding to one phosphor to reduce the scattering of the electron beams. However, there are limits to how small the emitters can be formed and problems occur with respect to phosphor illumination if the emitters are made too small. Difficulties with respect to focusing the electron beams also occur.

To prevent the scattering of the electron beams, there has been disclosed a configuration in which additional electrodes for focusing the electron beams are mounted in the vicinity of the gate electrodes. However, such a structure is applied mainly to FEDs employing the microtip configuration and not to a structure of flat emitters, in which case the focusing effect given is minimal.

SUMMARY OF THE INVENTION

In accordance with the present invention a field emission display is provided that improves the structure of electron emission sources and the configuration for focusing electron beams generated by the electron emission sources, to thereby improve an overall quality of the field emission display.

In one embodiment, the present invention provides a field emission display including a first substrate. At least one gate electrode is formed in a predetermined pattern on the first substrate. A plurality of cathode electrodes is formed on the first substrate in a predetermined pattern. At least one first insulation layer is formed between the at least one gate electrode and the plurality of cathode electrodes. At least one emitter is mounted within an opening of the cathode electrode. At least one second insulation layer is formed on the cathode electrode. At least one focusing electrode is formed on the second insulation layer. A second substrate is provided opposing the first substrate with a predetermined gap therebetween, the first and second substrates forming a vacuum assembly when interconnected. An anode electrode is formed on at least one side of the second substrate opposing the first substrate. A phosphor layer is formed on at least one side of the anode electrode in a pattern corresponding to positions of the emitter.

The cathode electrodes and the gate electrodes may be crossed in a stripe pattern. Alternatively, the cathode electrodes and the anode electrodes may be crossed in a stripe pattern. The second insulation layer has a channel formed corresponding to the emitter, the second insulation layer being formed on the cathode electrode such that the emitter is positioned within the channel.

In another embodiment, the present invention provides a field emission display including a first substrate. A plurality of gate electrodes is formed in a predetermined pattern on the first substrate. A plurality of cathode electrodes is formed on the first substrate in a predetermined pattern, the cathode electrodes forming intersection regions with the gate electrodes corresponding to pixel regions. At least one first insulation layer is formed between the at least one gate electrode and the plurality of cathode electrodes; Emitters are mounted within openings of the cathode electrodes formed in the intersection regions. A second insulation layer has a plurality of channels formed corresponding to the emitters, the second insulation layer being formed on the cathode electrodes such that the emitters are positioned within the channels. Focusing electrodes are formed on the second insulation layer. A second substrate is provided opposing the first substrate with a predetermined gap therebetween, the first and second substrates forming a vacuum assembly when interconnected. An anode electrode is formed on at least one side of the second substrate opposing the first substrate. Phosphor layers are formed on at least one side of the anode electrode in a pattern corresponding to positions of the emitters.

The emitters are formed as longitudinal single structures with long ends in a direction along which the gate electrodes are patterned. The channels are formed by a stepped portion of the second insulation layer.

The second insulation layer includes first sub-insulation layers having openings formed to substantially identical dimensions as the openings of the cathode electrodes when viewing the field emission display in a first direction normal to an outer surface of the second substrate, and second sub-insulation layers having openings that are larger than the openings of the first sub-insulation layers when viewed in the first direction. The channels are formed by the openings of the first sub-insulation layers and the openings of the second sub-insulation layers. That is, the channels are formed by sequentially depositing the first and second sub-insulation layers having different sizes to thereby form the stepped portion of the second insulation layer.

Also, the focusing electrodes are formed by coating a conductive material on upper surfaces of the first sub-insulation layers and on upper surfaces and side walls of the second sub-insulation layers.

In accordance with an embodiment of the present invention, the second insulation layer may be opaque, and the emitters may be realized through carbon nanotubes. The emitters may be divided into a plurality of sections for each pixel.

In accordance with further embodiments of the present invention, a field emission display is provided having a first substrate. At least one gate electrode is formed in a predetermined gate electrode pattern on the first substrate. A plurality of cathode electrodes is formed on the first substrate in a predetermined pattern. At least one first insulation layer is formed between the at least one gate electrode and the plurality of cathode electrodes. Emitters electrically contact the cathode electrodes. A second substrate is provided opposing the first substrate with a predetermined gap therebetween, the first substrate and the second substrate forming a vacuum container. At least one anode electrode is formed in a predetermined anode electrode pattern on a surface of the second substrate opposing the first substrate. Phosphor layers are formed in a predetermined phosphor layer pattern on the anode electrode Portions of the cathode electrodes are removed to form emitter-receiving sections, one of the emitters being provided in each of the emitter-receiving sections electrically contacting the cathode electrodes. A pixel region is formed between an emitter and a respective phosphor layer of the predetermined phosphor layer pattern at each intersection of: a cathode electrode and a gate electrode when the anode electrode is a common anode electrode, or a cathode electrode and an anode electrode when the gate electrode is a common gate electrode. Predetermined voltages are applied to the at least one anode electrode, cathode electrodes and the at least one gate electrode generating an electric field between respective gate electrodes and the emitters such that electrons emitted from emitters are induced toward and strike the phosphor layer in a corresponding pixel region to realize predetermined images. The at least one gate electrode formed in a predetermined gate electrode pattern can be a plurality of gate electrodes formed in a striped pattern and the at least one anode electrode formed in a predetermined anode electrode pattern being one anode electrode functioning as the common electrode. The at least one anode electrode formed in a predetermined anode electrode pattern can be a plurality of anode electrodes formed in a striped pattern and the at least one gate electrode formed in a predetermined gate electrode pattern being one gate electrode functioning as the common electrode.

Those skilled in the art would appreciate that with the cathode electrodes being scanning electrodes, the plurality of gate electrodes would provide data information, or vice versa. With the cathode electrodes being scanning electrodes, the plurality of anode electrodes would provide data information, or vice versa.

DETAILED DESCRIPTION

Figure 1:
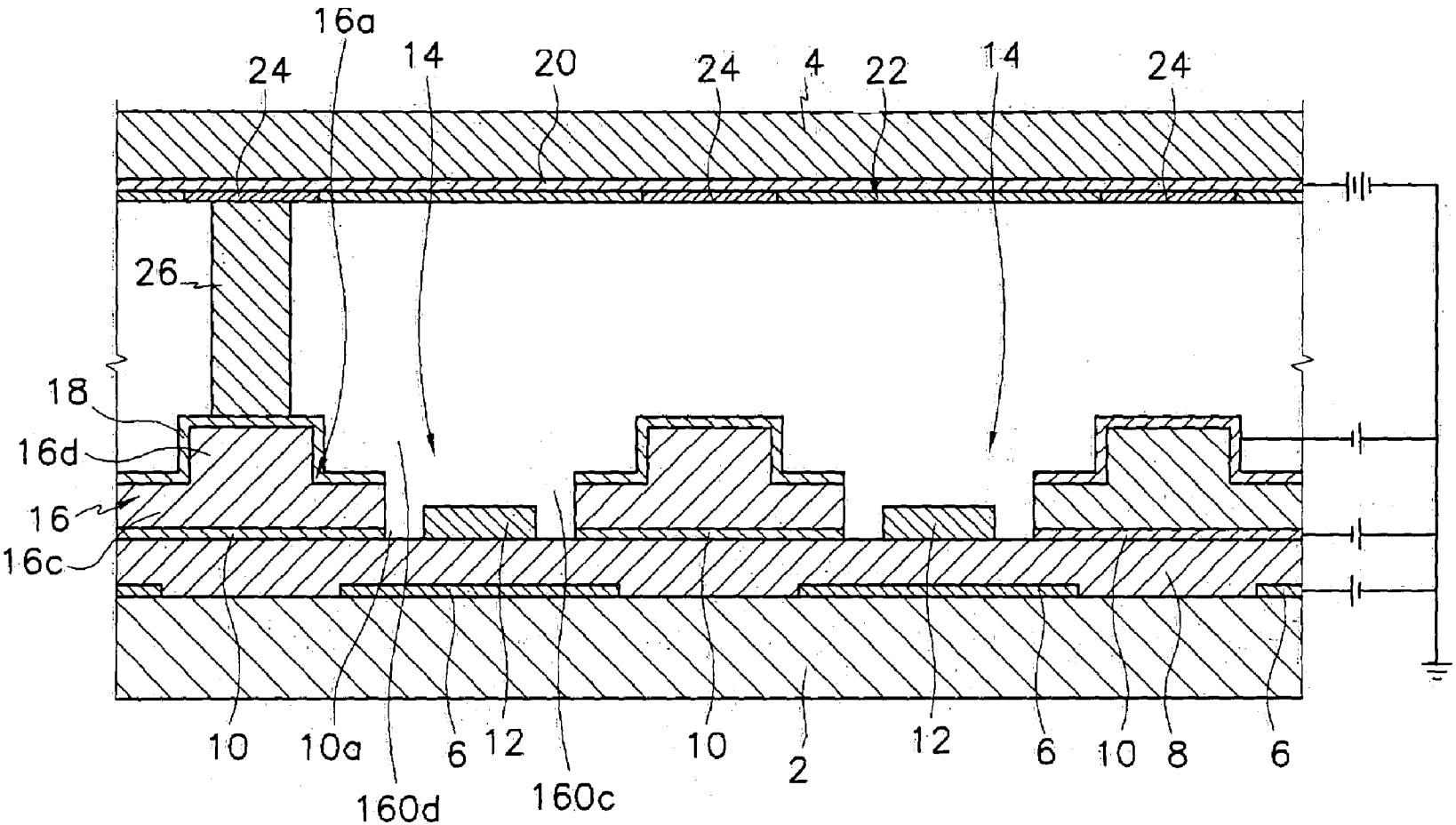
FIG. 1 is a partial sectional view of a field emission display according to a first embodiment of the present invention.
Figure 2:
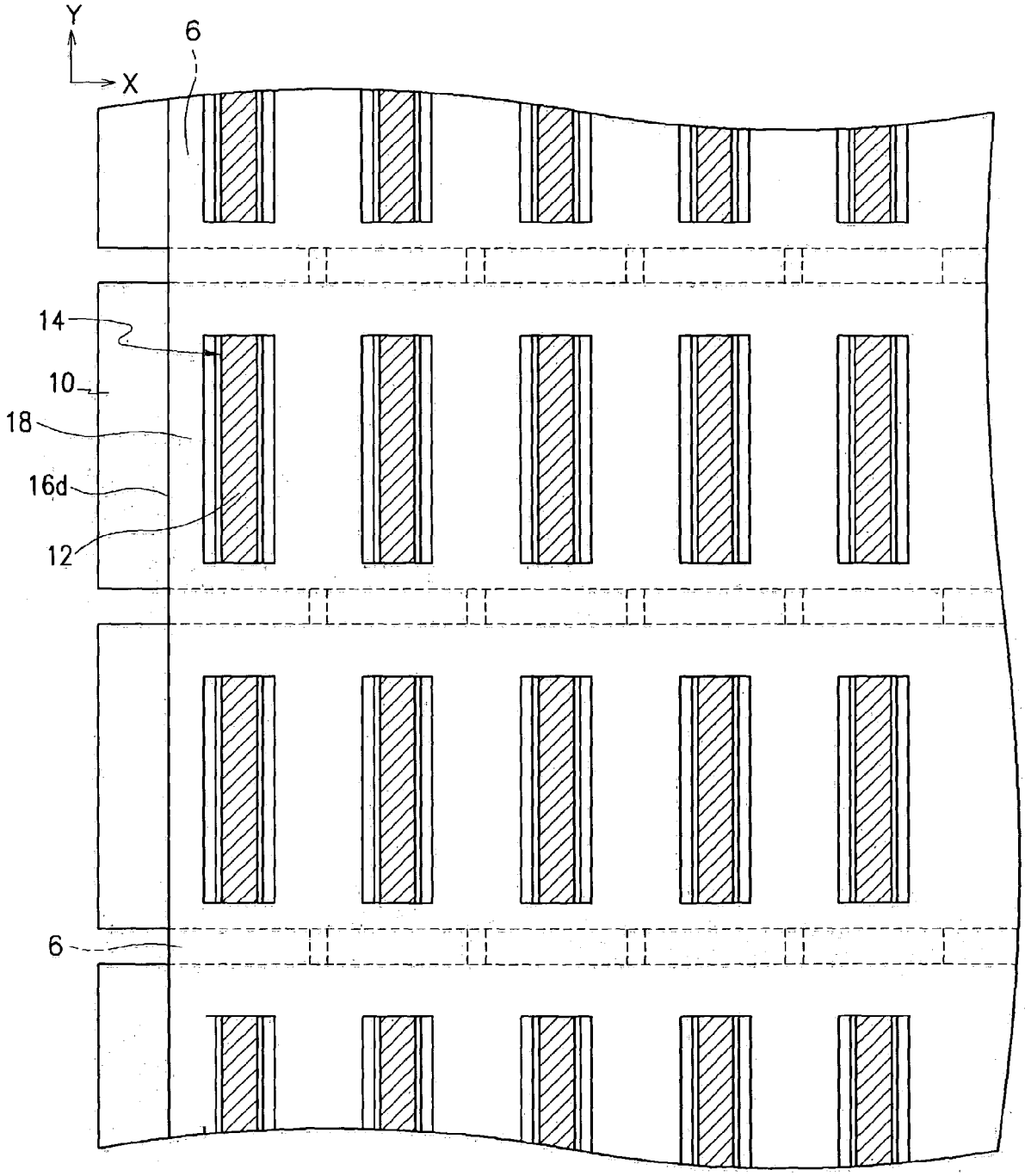
FIG. 2 is a partial plan view of elements provided on a first substrate of the field emission display of FIG. 1.

FIG. 1 is a partial sectional view of an FED according to a first embodiment of the present invention. FIG. 2 is a partial plan view of elements provided on a first substrate of the FED of FIG. 1.

As shown in the drawings, the FED according to the first embodiment of the present invention includes first substrate 2 of predetermined dimensions and second substrate 4 of predetermined dimensions, second substrate 4 being provided substantially in parallel to first substrate 2 and at a predetermined distance therefrom to form a gap between first substrate 2 and second substrate 4. When interconnected, first substrate 2 and second substrate 4 form an exterior of the FED and also a vacuum assembly. First substrate 2 will hereinafter be referred to as the rear substrate and the second substrate 4 will hereinafter be referred to as the front substrate.

A structure to enable the generation of an electric field is provided on rear substrate 2 and a structure to enable the realization of predetermined images by electrons emitted as a result of the generated electric field is provided on front substrate 4. This will be described in more detail below.

A plurality of gate electrodes 6 is formed on rear substrate 2 in a predetermined pattern (e.g., a striped pattern) and at predetermined intervals. Gate electrodes 6 are provided in their pattern along an axis Y direction of rear substrate 2.

Transparent first insulation layer 8 is deposited at a predetermined thickness over an entire surface of rear substrate 2 and covering gate electrodes 6.

A plurality of opaque cathode electrodes 10 is formed on first insulation layer 8 at predetermined intervals and perpendicularly intersecting gate electrodes 6 to form pixel regions. That is, cathode electrodes 10 are formed in a striped pattern along an axis X direction, which is perpendicular to the axis Y direction. Openings 10*a* that expose first insulation layer 8 are formed in cathode electrodes 10 where cathode electrodes 10 intersect gate electrodes 6.

Openings 10*a*, with particular reference to FIG. 2, are substantially longitudinal with lengths in the axis Y direction. In addition to openings 10*a*, such a longitudinal shape is used also for emitters and phosphor layers, which will be described below. Also, embodiments of the present invention are not limited to the longitudinal shape used for these elements and it is possible to employ other configurations.

Emitter 12 is formed on insulation layer 8 in each of the openings 10*a*. Emitters 12 are also longitudinal with long sides in the axis Y direction. Further, emitters 12 are planar and have a thickness that is greater than a thickness of cathode electrodes 10. Emitters 12 emit electrons by electric fields formed by voltages applied to gate electrodes 6 and cathode electrodes 10, and electrons are emitted as a result. In accordance with an embodiment of the present invention, emitters 12 are formed of carbon-based material, that is, carbon nanotubes.

Channels 14 are formed on the lower substrate 2 around each of the emitters 12, and emitters 12 are provided within channels 14. That is, opaque second insulation layer 16 is formed covering cathode electrodes 10 while leaving openings 10*a* uncovered to thereby form channels 14. Channels 14 of second insulation layer 16 have a stepped configuration formed by stepped portions 16*a* in second insulation layer 16. In particular, each of the channels 14 has openings 160*c* and 160*d* that communicate with one of the openings 10*a* of the cathode electrodes 10, with openings 160*c* and 160*d* being formed respectively by first and second sub-insulation layers 16*c* and 16*d* of second insulation layer 16. First and second sub-insulation layers 16*c* and 16*d* are sequentially deposited having different sizes to thereby form openings 160*c* and 160*d* also to different sizes and thereby realize the stepped configuration.

Openings 160*c* of first sub-insulation layer 16*c* are formed to substantially identical dimensions as openings 10*a* of cathode electrodes 10 in the axis X and Y directions. Openings 160*d* of second sub-insulation layer 16*d*, on the other hand, are formed to a larger size than openings 160*c* of first sub-insulation layer 16*c* in the axis X and Y directions but having substantially the same shape. Therefore, openings 160*c* of first sub-insulation layer 16*c* and openings 160*d* of second sub-insulation layer 16*d* are longitudinal in shape with long sides in the axis Y direction.

Therefore, second insulation layer 16 forms channels 14 that have a stepped structure through the formation of openings 160*c* of first sub-insulation layer 16*c* and openings 160*d* of second sub-insulation layer 16*d* as described above. Also, when viewed from above, each of the openings 160*c* and 160*d* that form channels 14 is substantially longitudinal. It is to be noted that channels 14 are not limited to such a structure, and other configurations may be used such as channels 14 being formed with inclining or curved walls instead of the multi-stage, stepped walls.

Also formed on rear substrate 2 are focusing electrodes 18, which perform focusing of the electron beams generated by emitters 12. Focusing electrodes 18 are formed on second insulation layer 16. That is, focusing electrodes 18 are realized through thin film conductive material that is coated on upper surfaces of first sub-insulation layers 16*c* and on upper surfaces and side walls of second sub-insulation layers 16*d*.

With respect to front substrate 4, anode electrode 20 made of a transparent material such as ITO is formed on a surface of front substrate 4 opposing rear substrate 2. Also, phosphor layers 22 made of red (R), green (G), and blue (B) phosphors are formed on anode electrode 20. The phosphors forming phosphor layers 22 have a longitudinal pattern corresponding to openings 10*a* of cathode electrodes 10 and emitters 12.

In addition, black matrix layers 24 are formed between phosphor layers 22 to increase contrast, and an optional metal thin film layer (not shown) can be formed over phosphor layers 22 and black matrix layers 24. The optional metal thin film layer enhances voltage withstanding and brightness characteristics of the FED. The ITO anode electrode coupled with the metal thin film layer would be typically used in high voltage applications.

Reference numeral 26 in FIG. 1 indicates a spacer. A plurality of spacers 26 is provided at non-pixel regions between front substrate 4 and rear substrate 2 to maintain the gap therebetween.

In the FED structured as described above, predetermined external voltages are applied to gate electrodes 6, cathode electrodes 10, focusing electrodes 18, and anode electrode 20. For example, a positive voltage of a few to a few tens of volts is applied to gate electrodes 6, a negative voltage of a few to a few tens of volts is applied to cathode electrodes 10, a negative voltage of a few to a few tens of volts is applied to focusing electrodes 18, and a positive voltage of a few hundred to a few thousand volts is applied to anode electrode 26. The cathode electrodes would typically function as scanning electrodes while the gate-electrodes provide data information, or vice versa. As a result, electric fields are formed between gate electrodes 6 and cathode electrodes 10 such that electrons are emitted from emitters 12. Also, the emitted electrons are formed into electron beams and induced toward the phosphor layers 22 to land on the same. As a result, phosphor layers 22 are illuminated to realize predetermined images.

During operation of the FED, focusing electrodes 18 perform focusing of the electron beams, which are formed by the electrons emitted from emitters 12, when they travel toward phosphor layers 22.

Figure 3A:
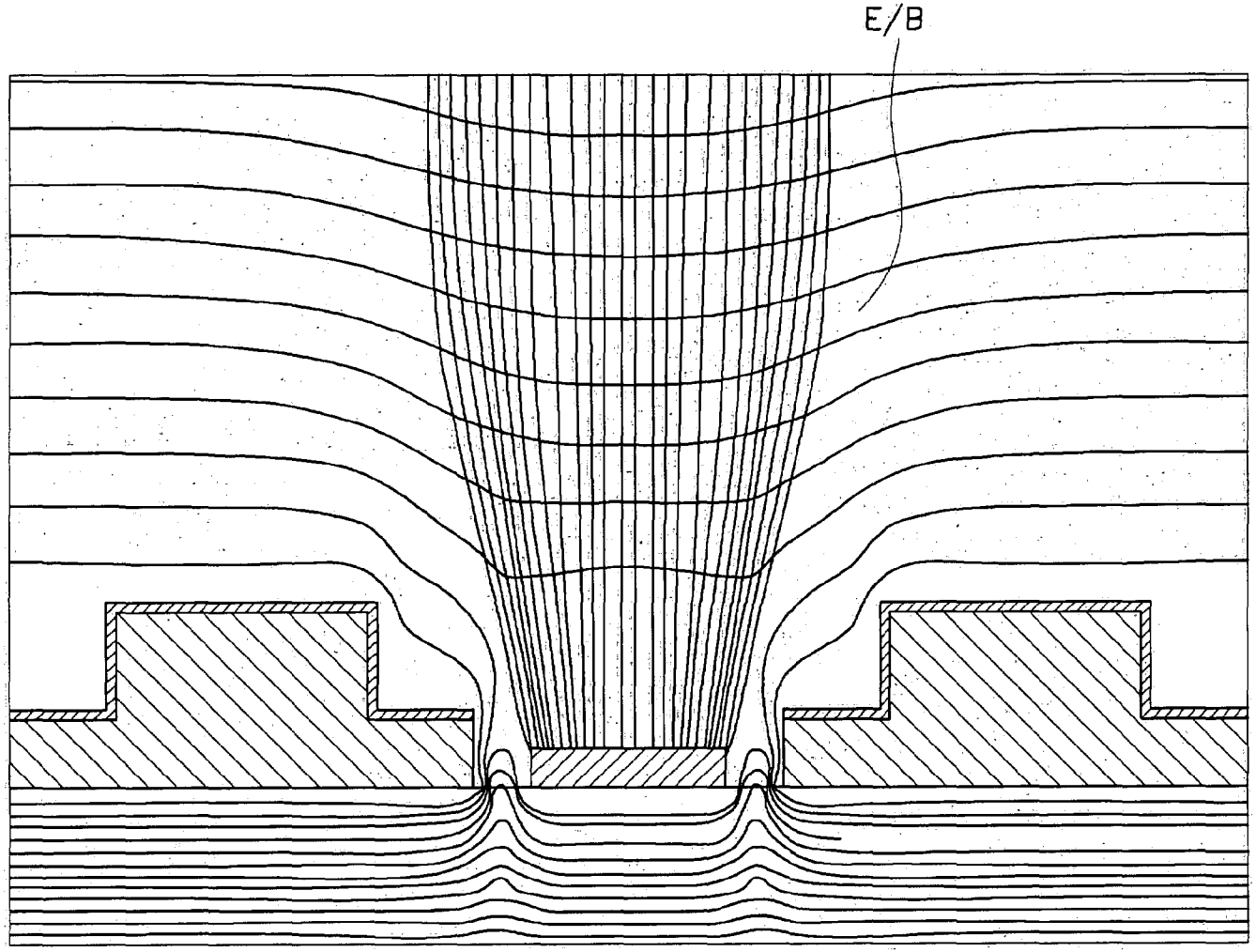
FIGS. 3*a* and 3*b* show results of a computer simulation illustrating a trace of an electron beam emitted from an emitter of the field emission display of FIG. 1.
Figure 3B:
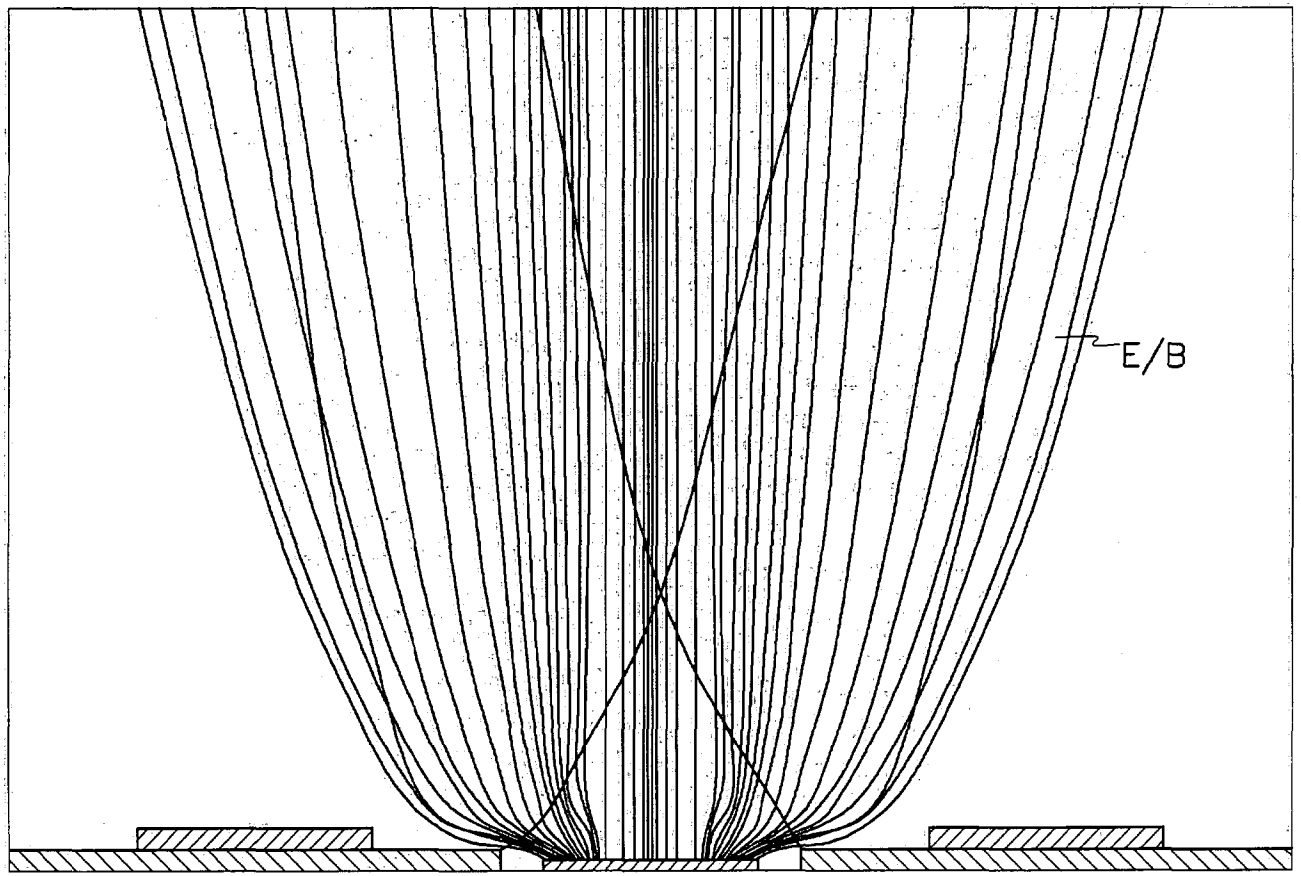

FIGS. 3*a* and 3*b* show results of a computer simulation illustrating a trace of an electron beam emitted from one of the emitters 12. FIG. 3*a* shows an overall trace of an electron beam traveling toward a corresponding phosphor layer 22, while FIG. 3*b* is an enlarged view showing a trace of an electron beam in the area of one of the channels 14.

Figure 4A:
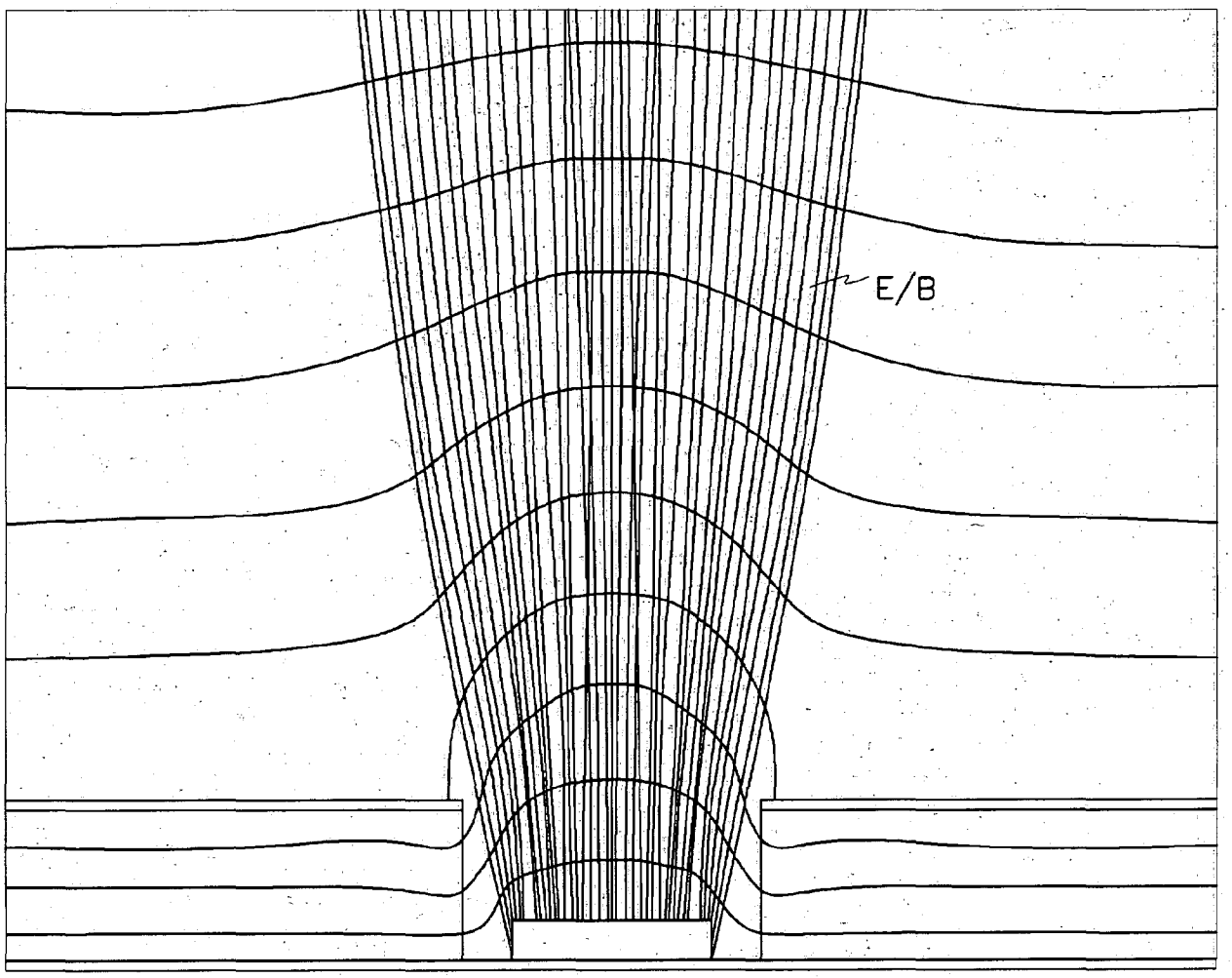
FIGS. 4*a* and 4*b* show results of a computer simulation illustrating a trace of an electron beam emitted from an emitter of a conventional field emission display (i.e., comparative example) employing a triode structure.
Figure 4B:
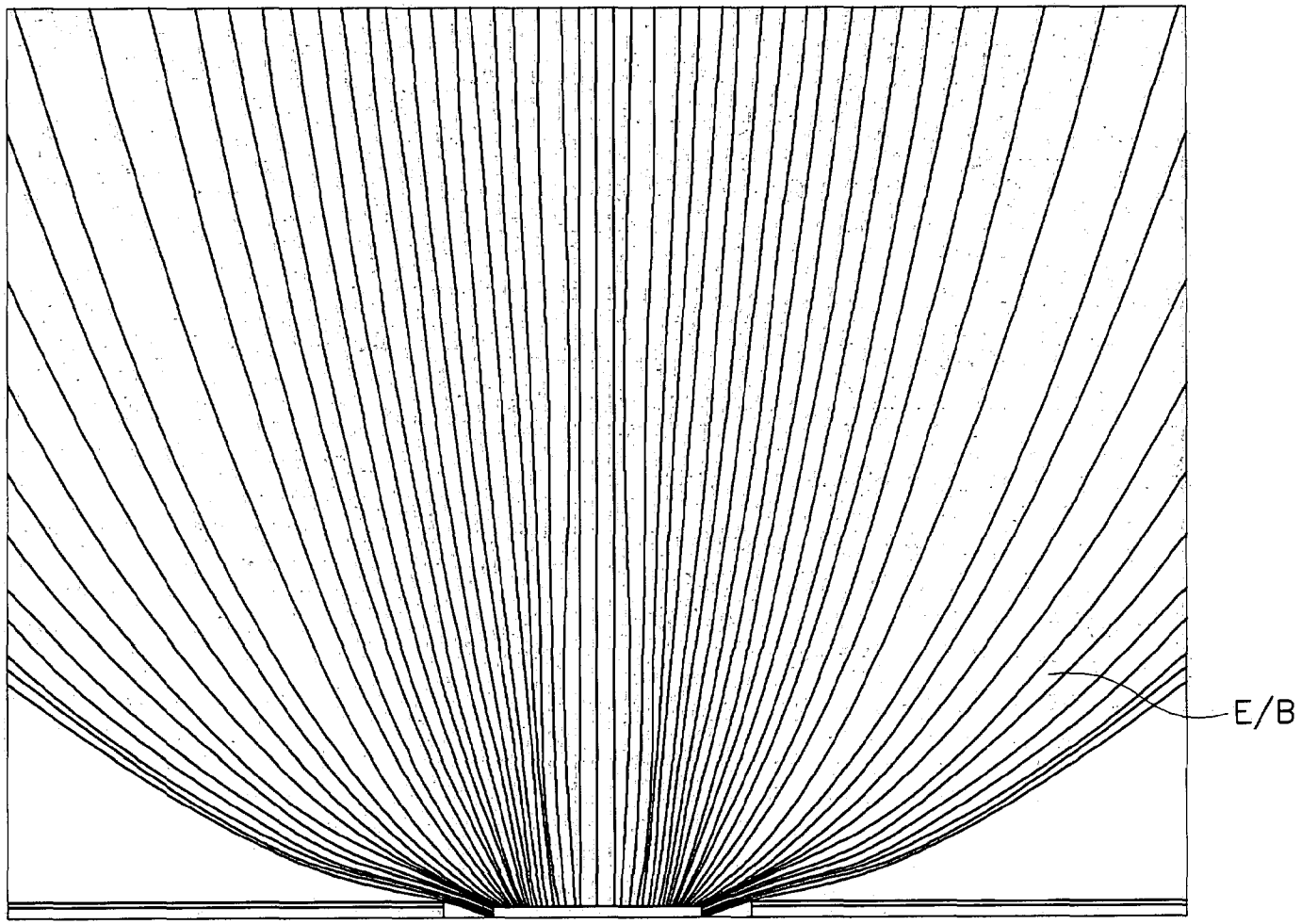

As shown in the drawings, electron beam E/B emitted from emitter 12 does not scatter outside of the range of the pixels of the corresponding pixel and is irradiated toward a center of the pixel. This is in contrast to the electron beam E/B generated in the conventional FED as shown in FIGS. 4*a* and 4*b*. The conventional FED used as the comparative example is structured by first forming cathode electrodes on a lower substrate, which is different from the present invention, then forming the gate electrodes on the cathode electrodes. The FED of the comparative example does not include focus electrodes.

The FED of the present invention is able to form traces of electron beams as described above for the following reason. When electron beam E/B emitted from emitter 12 passes the area of focusing electrodes 18, focusing electrodes 18 prevent outer areas of electron beam E/B from expanding outwardly as a result of the electric fields of a negative polarity that focusing electrodes 18 form. Such a repelling force applied to electron beam E/B also acts to focus the same so that electron beam E/B travels toward a center of corresponding phosphor layer 22. On the other hand, in the conventional FED as shown in FIG. 4*b*, the degree of scattering of electron beam E/B is substantial and significantly greater than in the FED in accordance with of the embodiment of the present invention.

Figure 5:
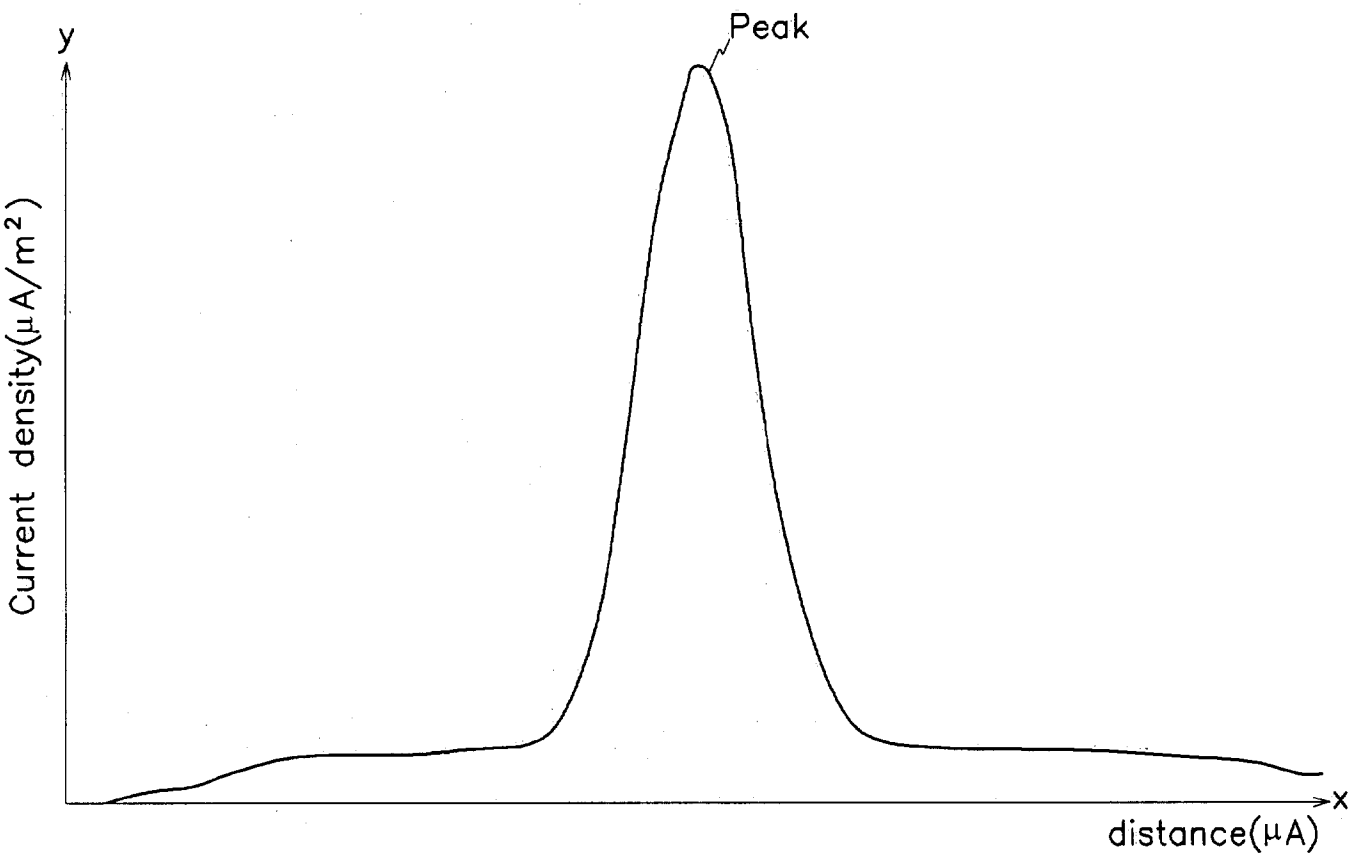
FIG. 5 is a graph showing a current density of electron beams as a function of distance from a center of a corresponding phosphor layer in the field emission display of FIG. 1.
Figure 6:
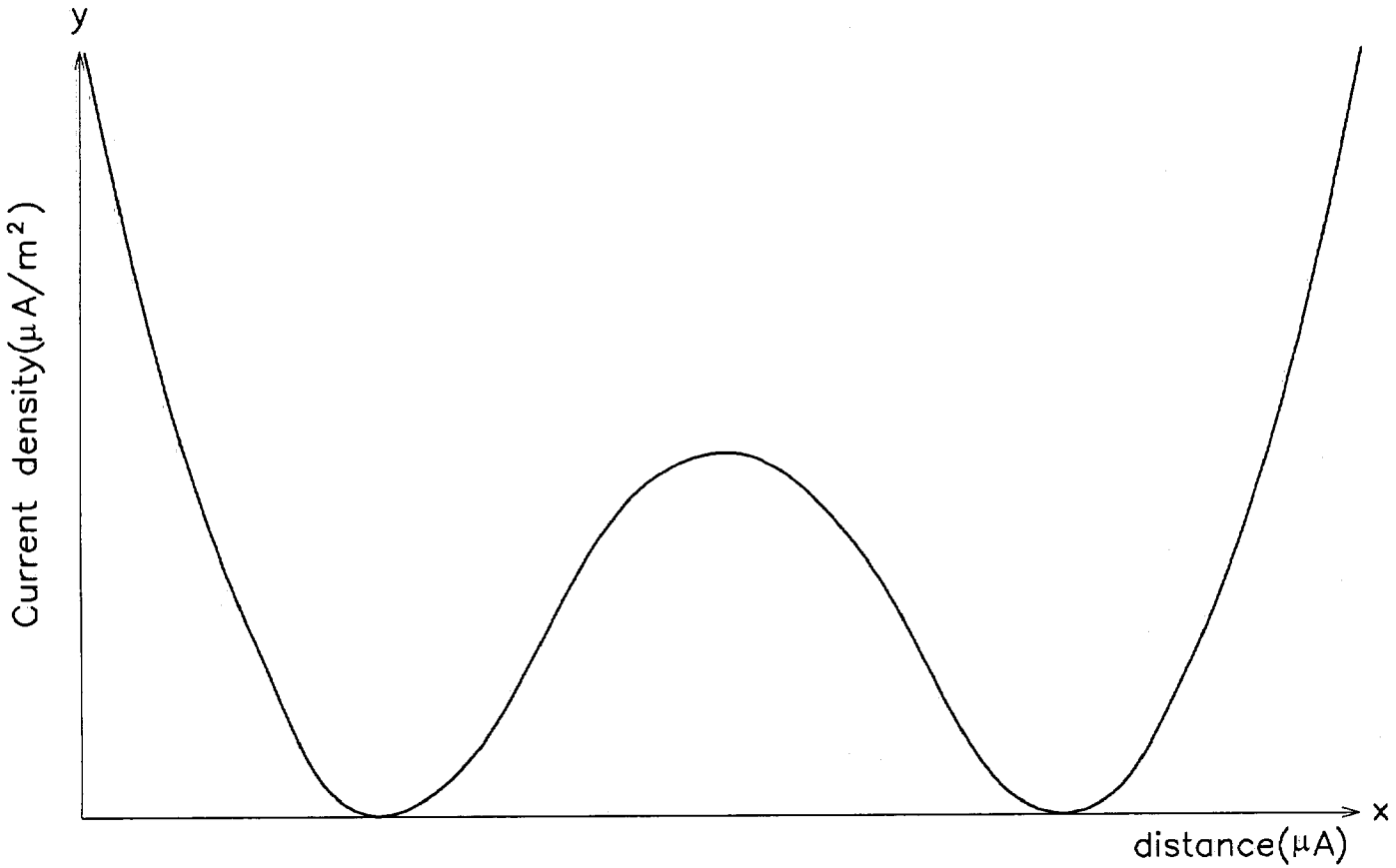
FIG. 6 is a graph showing a current density of electron beams as a function of distance from a center of a corresponding phosphor layer in the field emission display of the comparative example.

With reference to FIG. 5, a peak value in current density of the electron beam E/B occurs at a center area of corresponding phosphor layer 22 in accordance with an embodiment of the present invention. However, with reference to FIG. 6, in the FED of the comparative example peak values in current density of the electron beam occur at peripheries of the corresponding phosphor layer while the level of the current density at the center of the phosphor is significantly lower than in accordance with the present invention.

It is clear from the above that in the FED in accordance with the present invention, the electron beams emitted from emitters 12 are prevented from scattering toward unintended phosphor layers 22 and landing on the same. Instead, the electron beams are better focused onto intended phosphor layers 22 to land on and illuminate the same, thereby maintaining color purity.

Figure 7:
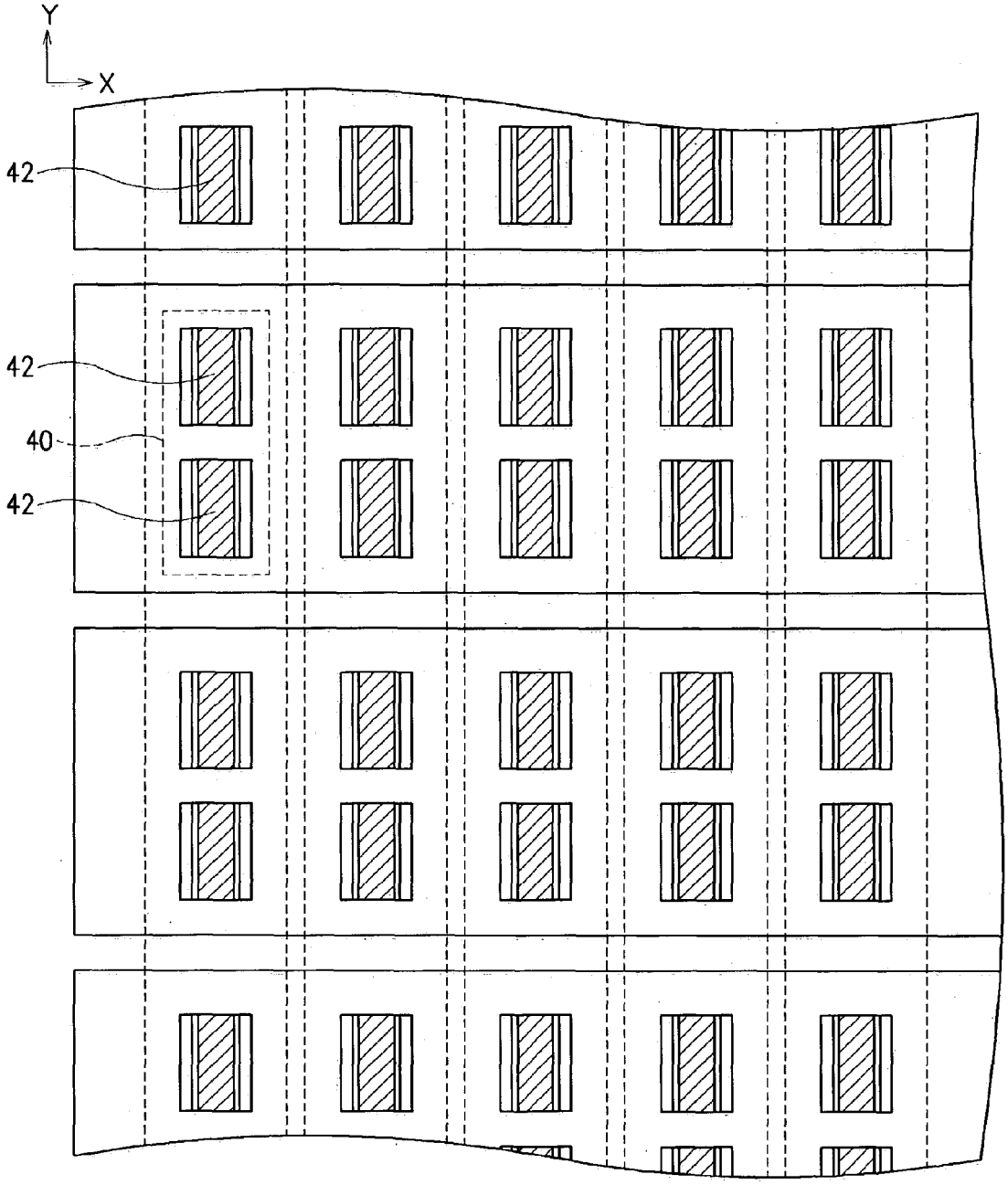
FIG. 7 is a partial plan view of a field emission display according to a second embodiment of the present invention.
Figure 8:
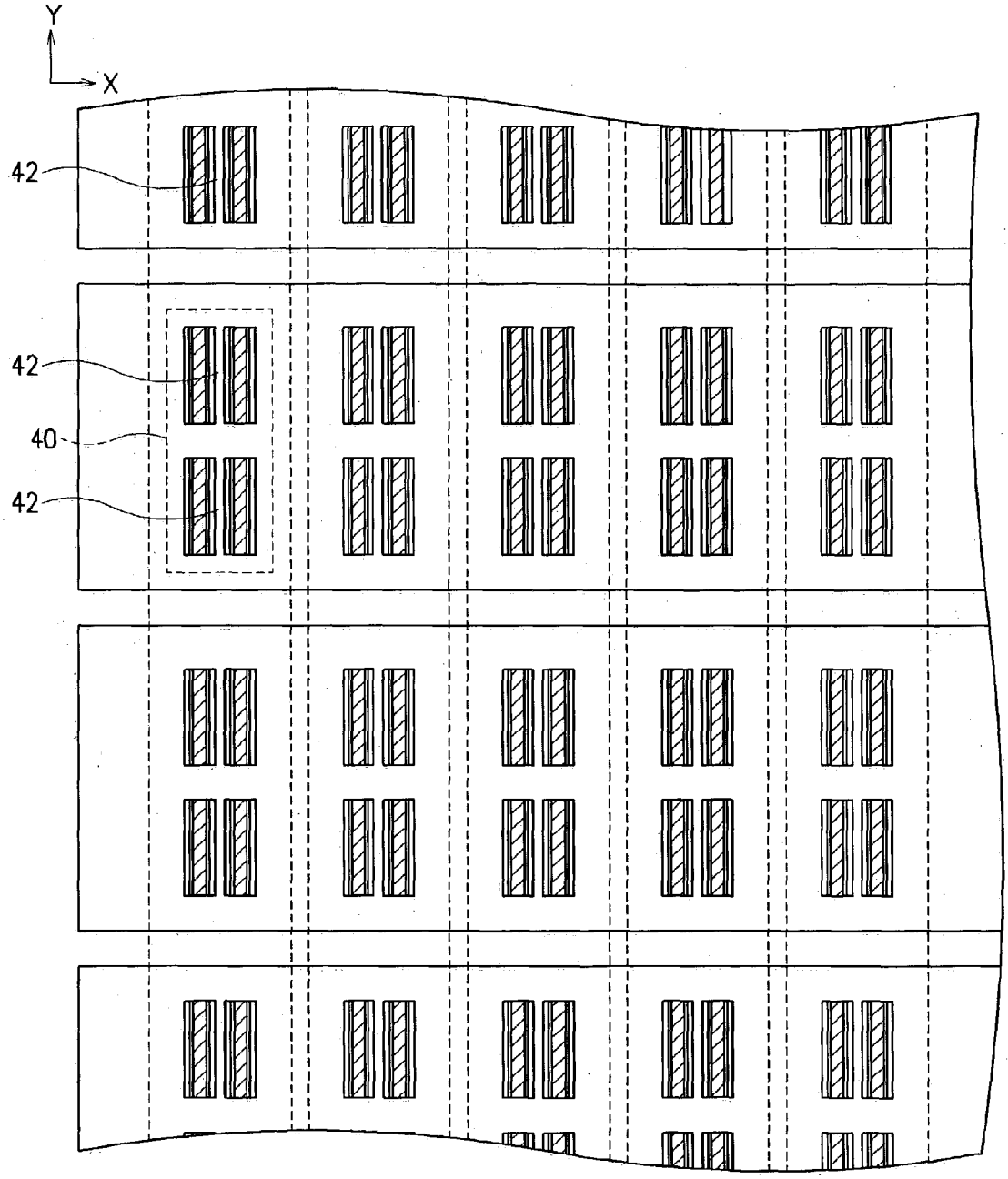
FIG. 8 is a partial plan view of a field emission display according to a third embodiment of the present invention.

Other embodiments of the present invention will now be described. FIGS. 7 and 8 show partial plan views of FEDs respectively according to second and third embodiments of the present invention. In the FED according to these embodiments, emitters 42 corresponding to pixels 40 are divided. That is, emitters 42 are divided within each pixel 40. For example, the emitters 42 are divided into two sections in the second embodiment of FIG. 7, and into four sections in the third embodiment of FIG. 8. Except for such a division of emitters 42, the remaining structures of the second and third embodiments of the present invention are identical to that described above with reference to the first embodiment. A detailed description of the remaining structures will therefore not be provided.

With such a division of emitters 42 for each of the pixels 40, the advantages realized with the first embodiment are improved upon to thereby further enhance the resolution of the FED.

In the FED of the present invention structured and operating as described above, the electron beams emitted from the emitters land only on intended phosphor layers to illuminate,the same. This is done while realizing a simple structure of forming an emitter(s) on a corresponding cathode electrode for each of the pixels. Therefore, a reduction in color purity by the electron beams landing on unintended phosphor layers is prevented.

Also, by the formation of the emitters in single structures, a greater number of electrons are emitted from the emitters such that better picture quality is realized. In addition, by increasing an area of the emitters, the emitter durability is increased, especially when the FED is operated for long periods. Finally, with the division of the emitters for each of the pixels as in the second and third preferred embodiments, picture resolution is significantly improved.

Figure 9:
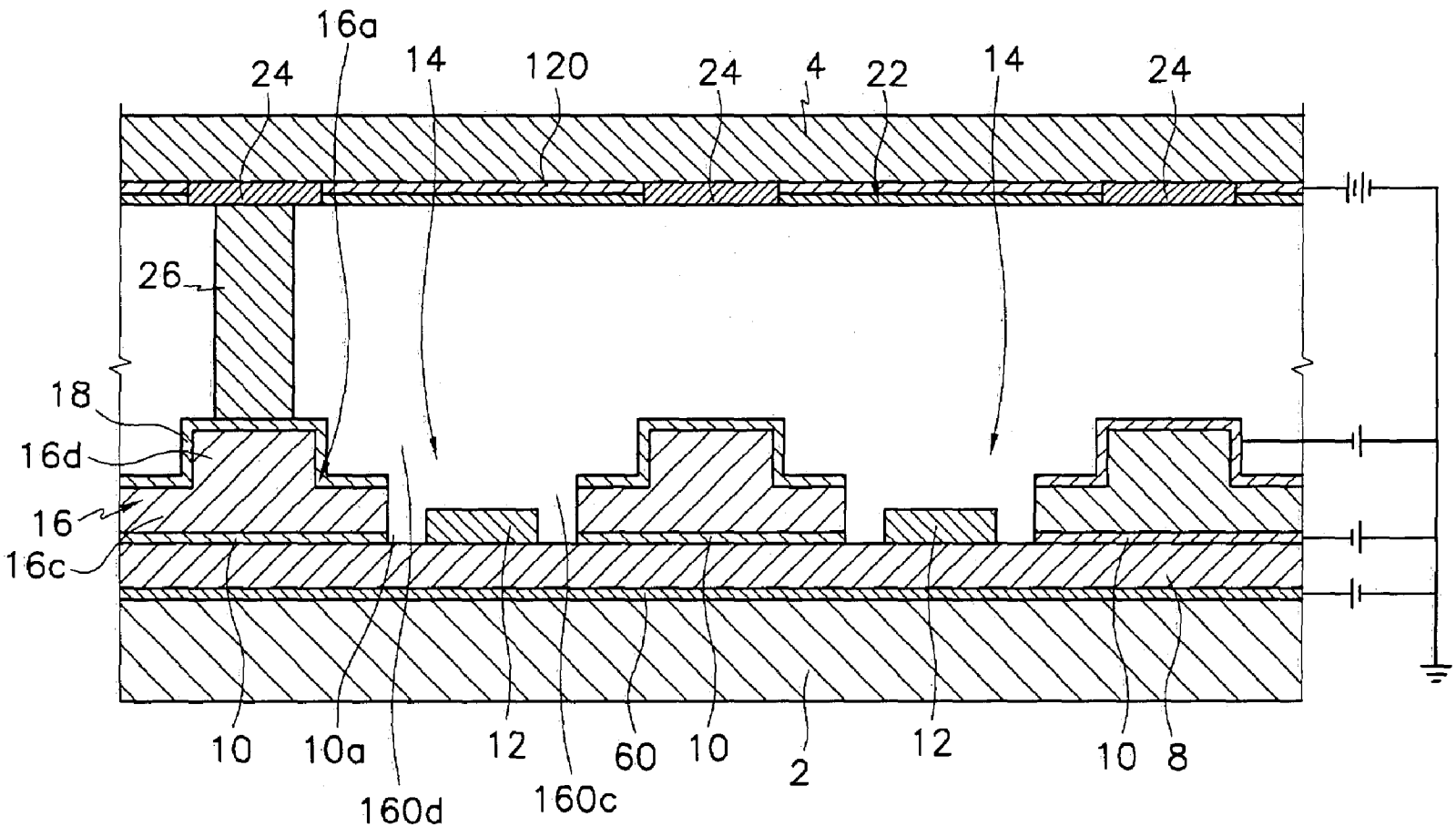
FIG. 9 is a partial sectional view of a field emission display according to according a further embodiment of the present invention.

Those skilled in the art can appreciate that further embodiments of the present field emission display invention can be implemented. Referring to FIG. 9 for example, at least one anode electrode 120 can be formed in a striped pattern while having one gate electrode 60 function as the common electrode. The remaining portions and their functions would be as described above for FIG. 1 and the alternative embodiments shown in FIGS. 7 and 8. Those skilled in the art would then appreciate that the cathode electrodes could receive scanning information while the anode electrodes receive data information and vice versa.

Those skilled in the art can further appreciate that the embodiments of FIGS. 1 and 9 could have further alternative implementations. For example, referring to FIG. 1, gate electrodes 6 and cathode electrodes 10 could alternate locations relative to first insulation layer 8. Similarly, referring to FIG. 9, gate electrodes 60 and cathode electrodes 10 could alternate locations relative to first insulation layer 8.

Those skilled in the art can also appreciate that an anode electrode in the various embodiments can be formed by a metal film, rather than being made of transparent material such as ITO. When the anode electrode is formed by a metal film, a phosphor layer is formed on a front substrate and the metal layer is formed on the phosphor layer.

Although several embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. A field emission display, comprising:

a first substrate;

at least one gate electrode formed in a predetermined pattern on the first substrate;

a plurality of cathode electrodes formed on the first substrate in a predetermined pattern;

at least one first insulation layer formed between the at least one gate electrode and the plurality of cathode electrodes;

at least one emitter mounted within an opening of the cathode electrode;

at least one second insulation layer being formed on the cathode electrode;

at least one focusing electrode formed on the second insulation layer;

a second substrate provided opposing the first substrate with a predetermined gap therebetween, the first and second substrates forming a vacuum assembly when interconnected;

at least one anode electrode formed on the second substrate opposing the first substrate; and phosphor layer formed on the at least one anode electrode in a pattern corresponding to positions of the emitter.

2. The field emission display of claim 1, wherein the cathode electrodes and the gate electrodes are crossed in a striped pattern.

3. The field emission display of claim 1, wherein the cathode electrodes and the anode electrodes are crossed in a striped pattern.

4. The field emission display of claim 1, wherein the second insulation layer has a channel formed corresponding to the emitter, the second insulation layer being formed on the cathode electrode such that the emitter is positioned within the channel.

5. The field emission display of claim 1, wherein the emitter is formed as longitudinal single structure with long ends in a direction along which the gate electrode is patterned.

6. The field emission display of claim 1, wherein a channel is formed by a stepped portion of the second insulation layer.

7. The field emission display of claim 6, wherein the second insulation layer includes first sub-insulation layer having an opening formed to substantially identical dimensions as the opening of the cathode electrode when viewing the field emission display in a first direction normal to an outer surface of the second substrate, and second sub-insulation layer having an opening that is larger than the opening of the first sub-insulation layers when viewed in the first direction, wherein the channel is formed by the opening of the first sub-insulation layer and the opening of the second sub-insulation layer.

8. The field emission display of claim 7, wherein the channel is formed by sequentially depositing the first and second sub-insulation layer having different sizes to thereby form the stepped portion of the second insulation layer.

9. The field emission display of claim 7, wherein the focusing electrode is formed by coating a conductive material on upper surfaces of the first sub-insulation layer and on upper surfaces and side walls of the second sub-insulation layer.

10. The field emission display of claim 1, wherein the second insulation layer is opaque.

11. The field emission display of claim 1, wherein the emitter includes carbon nanotubes.

12. The field emission display of claim 1, wherein the emitter is divided into a plurality of sections for each pixel.

13. A field emission display, comprising:

a first substrate;

a plurality of gate electrodes fanned in a predetermined pattern on the first substrate;

a plurality of cathode electrodes formed on the first substrate in a predetermined pattern, the cathode electrodes forming intersection regions with the gate electrodes corresponding to pixel regions;

at least one first insulation layer between the at least one gate electrode and the plurality of cathode electrodes;

an emitter mounted within openings of the cathode electrodes formed in the intersection regions;

a second insulation layer having a plurality of channels formed corresponding to the emitters, the second insulation layer being formed on the cathode electrodes such that the emitters are positioned within the channels;

focusing electrodes formed on die second insulation layer;

a second substrate provided opposing the first substrate with a predetermined gap wherebetween, the first and second substrate forming a vacuum assembly when interconnected:

an anode electrode formed on at least one side of the second substrate opposing the first substrate; and phosphor layers formed on at least one side of the anode electrode in a pattern corresponding to positions of the emitters.

14. The field emission display of claim 13, wherein the emitters are formed as longitudinal single structures with long ends in a direction along which the gate electrodes are patterned.

15. The field emission display of claim 13, wherein the channels are formed by a stepped portion of the second insulation layer.

16. The field emission display of claim 15, wherein the second insulation layer includes first sub-insulation layers having openings formed to substantially identical dimensions as the openings of the cathode electrodes when viewing the field emission display in a first direction normal to an outer surface of the second substrate, and second sub-insulation layers having openings that are larger than the openings of the first sub-insulation layers when viewed in the first direction.

17. The field emission display of claim 16, wherein the channels are formed by sequentially depositing the first and second sub-insulation layers having different sizes to thereby form the stepped portion of the second insulation layer.

18. The field emission display of claim 16, wherein the focusing electrodes are formed by coating a conductive material on upper surfaces of the first sub-insulation layers and on upper surfaces and side walls of the second sub-insulation layers.

19. The field emission display of claim 13, wherein the second insulation layer is opaque.

20. The field emission display of claim 13, wherein the emitters are carbon nanotubes.

21. A field emission display, comprising:

a first substrate;

at least one gate electrode formed in a predetermined gate electrode pattern on the first substrate;

a plurality of cathode electrodes formed on the first substrate in a predetermined pattern;

at least one first insulation layer formed between the at least one gate electrode and the plurality of cathode electrodes;

emitters electrically contacting the cathode electrodes;

a second substrate opposing the first substrate with a predetermined gap therebetween, the first substrate and the second substrate forming a vacuum container;

at least one anode electrode formed in a predetermined anode electrode pattern on a surface of the second substrate opposing the first substrate; and phosphor layers formed in a predetermined phosphor layer pattern on the anode electrode;

wherein portions of the cathode electrodes are removed to form emitter-receiving sections, one of the emitters being provided in each of the emitter-receiving sections electrically contacting the cathode electrodes;

wherein a pixel region is formed between an emitter and a respective phosphor layer of the predetermined phosphor layer pattern at each intersection of:

a cathode electrode and a gate electrode when the anode electrode is a common anode electrode, or a cathode electrode and an anode electrode when the gate electrode is a common gate electrode; and wherein predetermined voltages are applied to the at least one anode electrode, cathode electrodes and the at least one gate electrode generating an electric field between respective gate electrodes arid the emitters such that electrons emitted from emitters are induced toward and strike the phosphor layer in a corresponding pixel region to realize predetermined images.

22. The field emission display of claim 21, wherein the at least one gate electrode formed in a predetermined gate electrode pattern is a plurality of gate electrodes formed in a striped pattern and the at least one anode electrode formed in a predetermined anode electrode pattern is one anode electrode functioning as the common electrode.

23. The field emission display of claim 21, wherein the at least one anode electrode formed in a predetermined anode electrode pattern is a plurality of anode electrodes formed in a striped pattern and the at least one gate electrode formed in a predetermined gate electrode pattern is one gate electrode functioning as the common electrode.

* * * * *